United States Patent [19]

Lübke et al.

[11] Patent Number: 5,074,207

[45] Date of Patent: Dec. 24, 1991

[54] APPARATUS FOR MOVING A PUSH-IN TRUCK CARRYING A PRINTING CYLINDER INTO A PRINTING PRESS

[75] Inventors: Herbert Lübke, Lienen; Bruno Marquardt, Georgsmarienhütte/Holzhausen, both of Fed. Rep. of Germany

[73] Assignee: Windmoller & Holscher, Lengerich, Fed. Rep. of Germany

[21] Appl. No.: 531,408

[22] Filed: Jun. 4, 1990

[30] Foreign Application Priority Data

Jun. 6, 1989 [DE] Fed. Rep. of Germany ..... 3918450

[51] Int. Cl.[5] ..... B41F 13/20; B41F 13/44

[52] U.S. Cl. ..... 101/216

[58] Field of Search ..... 101/216, 152, 153, 212, 101/352, 219, 378

[56] References Cited

U.S. PATENT DOCUMENTS 4,046,070 9/1977 Halley ..... 101/153

4,137,843 2/1979 Ottenhue ..... 101/216

*Primary Examiner*—J. Reed Fisher

*Attorney, Agent, or Firm*—Fleit, Jacobson, Cohn, Price, Holman & Stern

[57] ABSTRACT

In an apparatus for moving a push-in truck carrying a printing cylinder into a printing press, the push-in truck is provided with two sliders, or with two guide rollers which are rotatably mounted on vertical axes, and said sliders or rollers are movable into a longitudinal groove, which is formed in a track rail, which is pivotally movable between a swung-out position for receiving the push-in truck and a swung-in position in which the stub shafts of the printing cylinder extend into apertures formed in the side parts of the frame of the printing press in positions in which said stub shafts are adapted to be connected to associated bearings.

11 Claims, 5 Drawing Sheets

APPARATUS FOR MOVING A PUSH-IN TRUCK CARRYING A PRINTING CYLINDER INTO A PRINTING PRESS

BACKGROUND OF THE INVENTION

1. Field of the Invention

This invention relates to an apparatus for moving a push-in truck carrying a printing cylinder into a printing press.

2. Description of the Prior Art

Push-in trucks of that kind are usually employed to move printing cylinders to such a position between the side frames of a printing press that the stub shafts of the printing cylinder extend into slots or recesses of the side walls and can then be connected to the associated bearings. The push-in trucks are also used to move printing cylinders out of a printing press when the stub shafts of the cylinder have been released from the associated bearings, as will be required, e.g., for a replacement of printing cylinders. Highly skilled operators are required for the actuation of the push-in trucks which carry the printing cylinder which is to be moved into or out of the printing press in such a manner that a collision of the push-in truck and the stub shafts of the printing cylinder with the side frames or other parts of the printing press and damage by impacts resulting from such collisions are to be prevented. It has been found in practice that gentle and even severe collisions of the push-in truck and the stub shafts of the printing cylinder with parts of the printing press cannot always be avoided even if the operators work with great care.

SUMMARY OF THE INVENTION

For this reason it is an object of the invention to provide an apparatus which is of the kind described first hereinbefore and which can be used to move a push-in truck carrying a printing cylinder into the frame of a printing press into which the printing cylinder is to be introduced and out of the printing press when the printing cylinder is to be removed so that this can be accomplished in such a manner that a collision of the push-in truck or of the printing press and damage resulting from such collision need not be feared.

In an apparatus which is of the kind described first hereinbefore that object is accomplished in that the push-in truck is provided with two sliders, or with two guide rollers which are rotatably mounted on vertical axes, and said sliders or rollers are movable into a longitudinal groove, which is formed in a track rail, which is pivotally movable between a swung-out position for receiving the push-in truck and a swung-in position in which the stub shafts of the printing cylinder extend into apertures formed in the side parts of the frame of the printing press in positions in which said stub shafts are adapted to be connected to associated bearings. By the apparatus in accordance with the invention, a collision of the push-in truck and of the printing cylinder with parts of the printing press and damages resulting from such collision will reliably be prevented. When the track rail is in its swung-out position the operator is only required to insert the sliders or guide rollers into the longitudinal groove of the track rail. This will not involve a risk of a collision because no part of the printing press is disposed adjacent to the track rail when it has been swung out. When the sliders or guide rollers of the push-in truck have been inserted into the longitudinal groove of the track rail, said rail is pivotally moved into the printing press so that the push-in truck will positively be guided to a position in which the stub shafts of the printing cylinder extend in the apertures formed in the side parts of the frame of the printing press and can be connected to the associated bearings in a manner which is known and for this reason need not be described in detail. During that movement a collision of the push-in truck and of the printing cylinder with parts of the printing press cannot occur. Similarly, printing cylinders can be moved out of the printing press without a risk of collision. During the printing operation the push-in truck held in the track rail may remain in its pushed-in position in the printing press and will then be in the proper position for a subsequent removal of the printing cylinder.

The push-in truck is suitably provided with levers, which are secured to the base frame of the truck and protrude outwardly from one longitudinal side of said base frame and are provided with vertical pins, which at their free bottom ends carry the sliders or guide rollers.

The push-in truck is suitably provided with four wheels, which are rotatably mounted in bifurcated bearing brackets, which are freely rotatably mounted on vertical axes, and the wheels consist of casters, which are mounted on axles which are spaced apart from the associated vertical axis.

In a desirable embodiment the push-in truck is provided with spaced apart mountings, which are provided with mounting surfaces, which define prismatic recesses for receiving the stub shafts of a printing cylinder, and one side part of each of said mountings is hinged and adapted to be swung off for releasing the printing cylinder. The spacing of the mountings from each other may be adjustable.

In accordance with a further feature of the invention the push-in truck and/or the frame of the printing press is provided with rollers, which are rotatable on vertical axes and constitute limiting stops. When the guide rollers of the push-in truck have been inserted into the longitudinal groove of the track rail in its swung-out position, the push-in truck will be advanced in the longitudinal groove until the rollers of the truck strike against associated sliding surfaces of a side part of the frame of the printing press or until guide rollers mounted on such side part strike against frame portions of the push-in truck. As the track rail is swung in, said rollers provide an additional guidance and ensure that the truck can be moved with low friction.

In a particularly desirable embodiment the track rail is articulatedly connected to the frame of the printing press by two links. Said links preferably differ in length so that they guide the track rail as it moves between its swung-in position, in which the track rail is at right angles to the side frames of the printing press, and its swung out position, in which the track rail extends at an acute angle to said side frames and is adapted to receive the guide rollers or sliders in the track groove.

In accordance with a further feature of the invention, drive means are provided for pivotally moving the track rail. That swivel drive will facilitate the movement of the push-in truck into and out of the printing press while the track rail is in the proper position because the operators will be required only to push the truck into the swung-out track rail. The subsequent swing-in movement can then automatically be imported to the rail and it will be sufficient for the operator to take care that the push-in truck remains completely received in the longitudinal groove of the track rail as the latter is pivotally moved. The drive means preferably comprise a fluid-operable piston-cylinder unit, which is pivoted at one end to a link and at the other end to the frame of the printing press.

DETAILED DESCRIPTION OF THE PREFERRED EMBODIMENT

Figure 1:
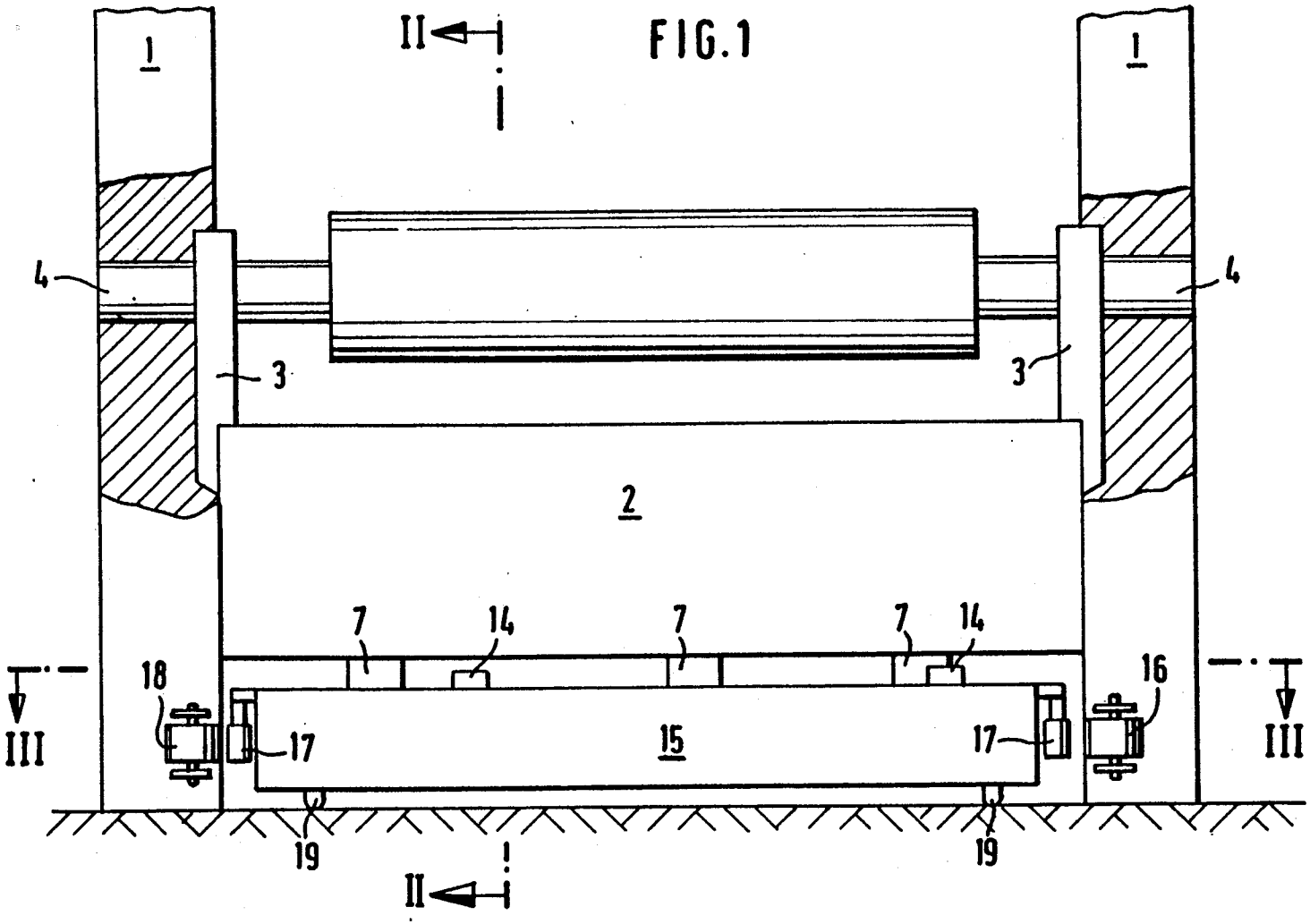
FIG. 1 is a diagrammatic front elevation showing a printing press and an associated push-in truck.

An illustrative embodiment of the invention will now be explained more in detail with reference to the drawing.

The two side frames 1 of a printing press are interconnected by a tubular beam 2, which at each end carries an upwardly directed carrying arm 3. The carrying arms 3 extend into recesses formed in the side frames 1. The side frames 1 are provided in known manner with slots 5 for receiving the stub shafts 4 of a printing cylinder. The carrying arms 3 are formed with recesses 6 for receiving said stub shafts. The design of the means by which the stub shafts 4 are locked in the slots 5 and in the recesses 6 need not be described because such means are known in the art.

Figure 3:
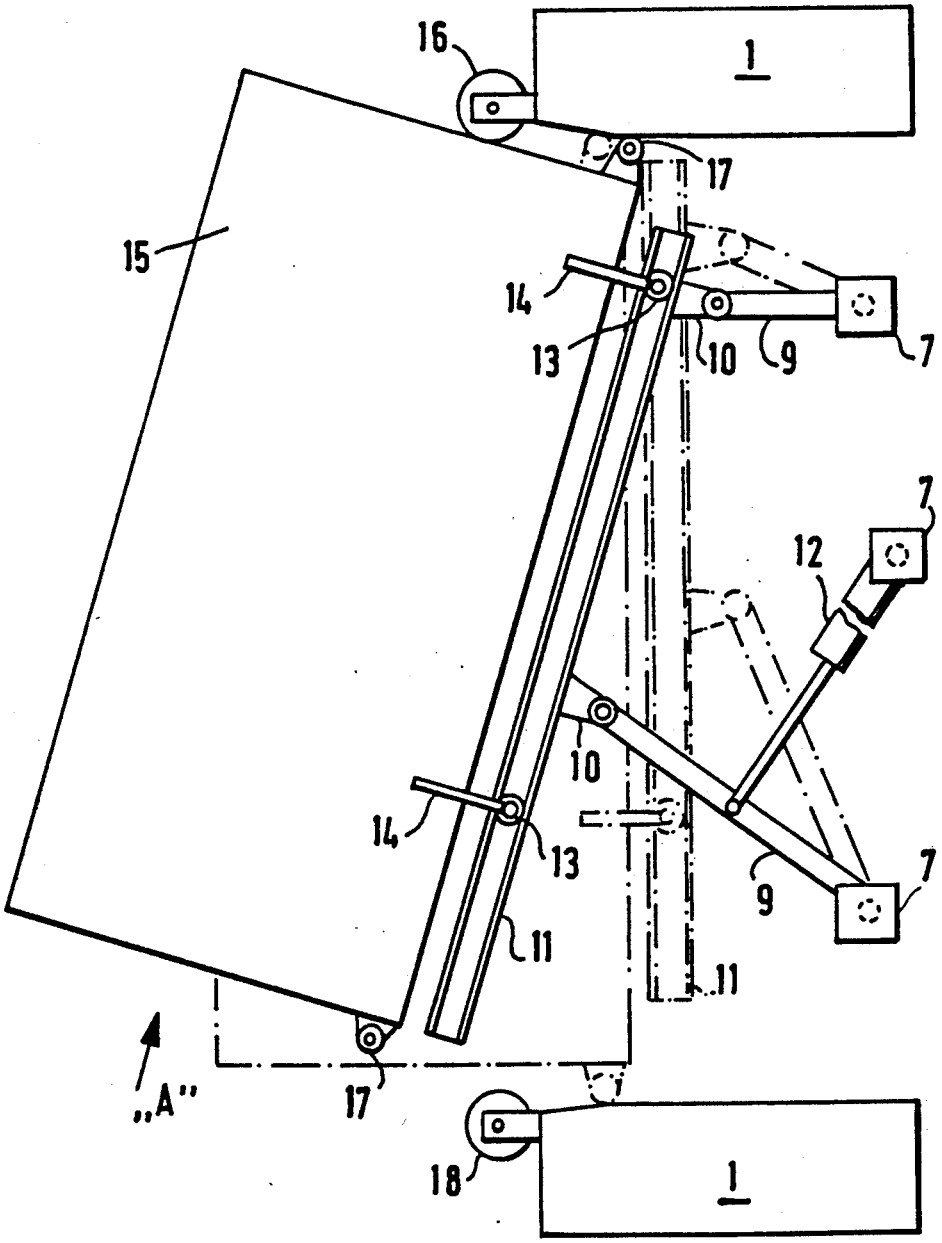
FIG. 3 is a top plan view showing the printing press and the push-in truck with the track rail in its swung-out position.

Depending holders 7 are secured to the tubular beam 2 and provided with depending pivot pins 8. Levers 9 are mounted on the two pivot pins which are carried by the two outer holders 7. At those ends which are remote from the pivot pins 8 and levers 9 are articulatedly connected to brackets 10, which are welded to and carry a channel-section track rail 11. A piston-cylinder unit 12 is connected at one end to the intermediate holder 7 and at the other end to one of the two levers 9 and is operable to impart to the track rail 11 a pivotal movement from a position shown in solid lines in FIG. 3 to a position which is indicated in phantom in FIG. 3. In a longitudinal groove, the track rail 11 receives two guide rollers 13, which are fixedly connected to the push-in truck 15 by arms 14 so that the pivotal movement of the track rail 11 will cause the push-in truck 15 to move to a position between the two side frames 1. In FIG. 3 the track rail 11 is shown in solid lines in an initial position, from which the rail is moved to introduce a new printing cylinder into the printing press. An operator which moves the push-in truck 15 carrying the printing cylinder to the rail 11 will merely have to take care that the two guide rollers 13 can move into the track rail 11 and will subsequently have to apply to the push-in truck 15 a pressure in the direction indicated by the arrow A. That pressure must be applied until the push-in truck 15 has engaged the guide-in roller 16. Thereafter the piston-cylinder unit 12 is operated so that, as has been mentioned hereinbefore, the track rail 11 is pivotally moved from its position indicated by solid lines to its position indicated in phantom. In order to ensure that a collosion of the push-in truck and the printing cylinder carried by said truck with the side frames 1 will be avoided during the inward pivotal movement of the track rail 11, spacer rollers 17 are mounted on to the push-in truck 15 and another guide-in roller 18 is mounted on one side frame 1. During the inward pivotal movement proper it will be sufficient for the operator to apply to the push-in truck only a light pressure in the direction indicated by the arrow A.

Figure 2:
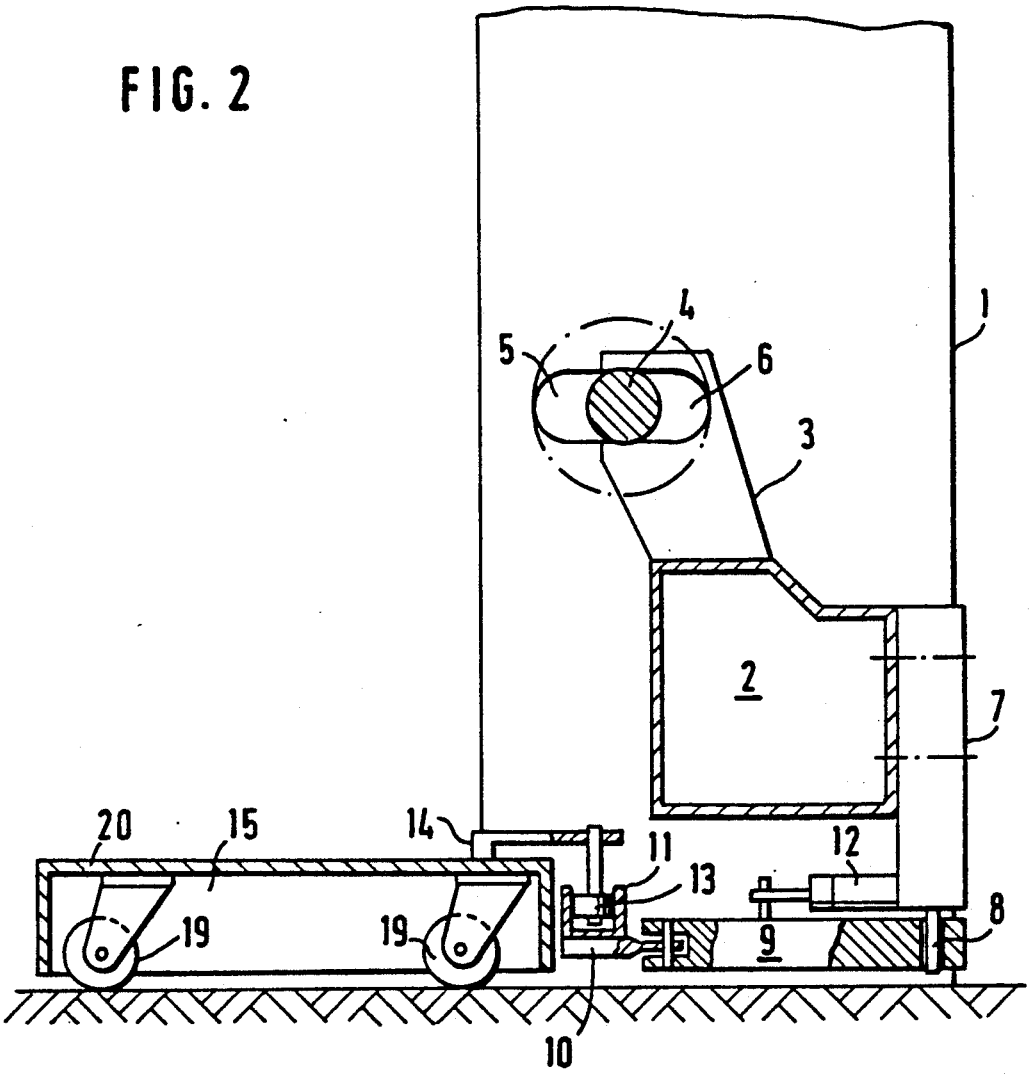
FIG. 2 is a longitudinal sectional view taken on line II—II in FIG. 1 and showing the printing press and the push-in truck.
Figure 4:
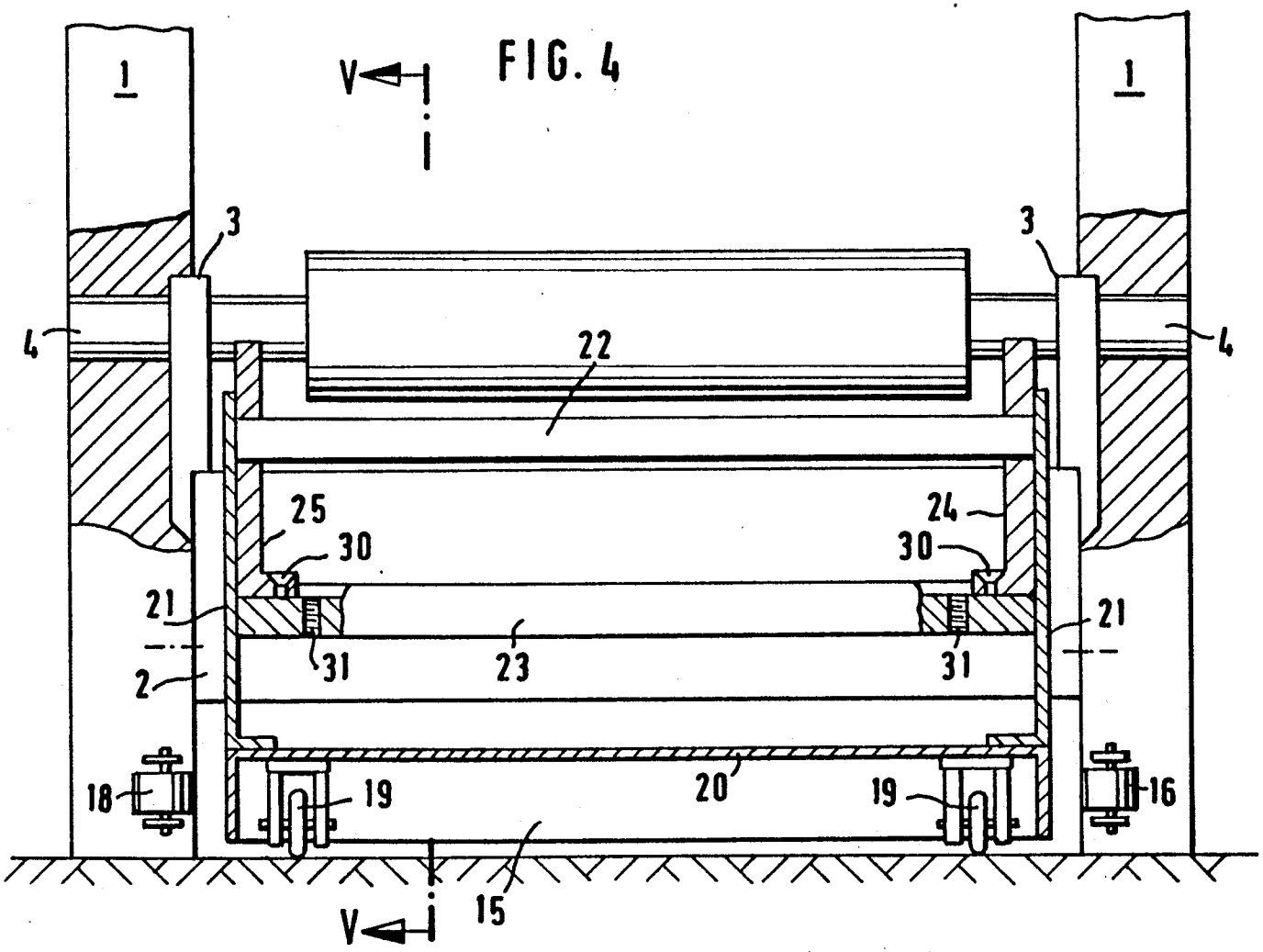
FIG. 4 is a view which is similar to FIG. 1 and shows the push-in truck partly in section.
Figure 5:
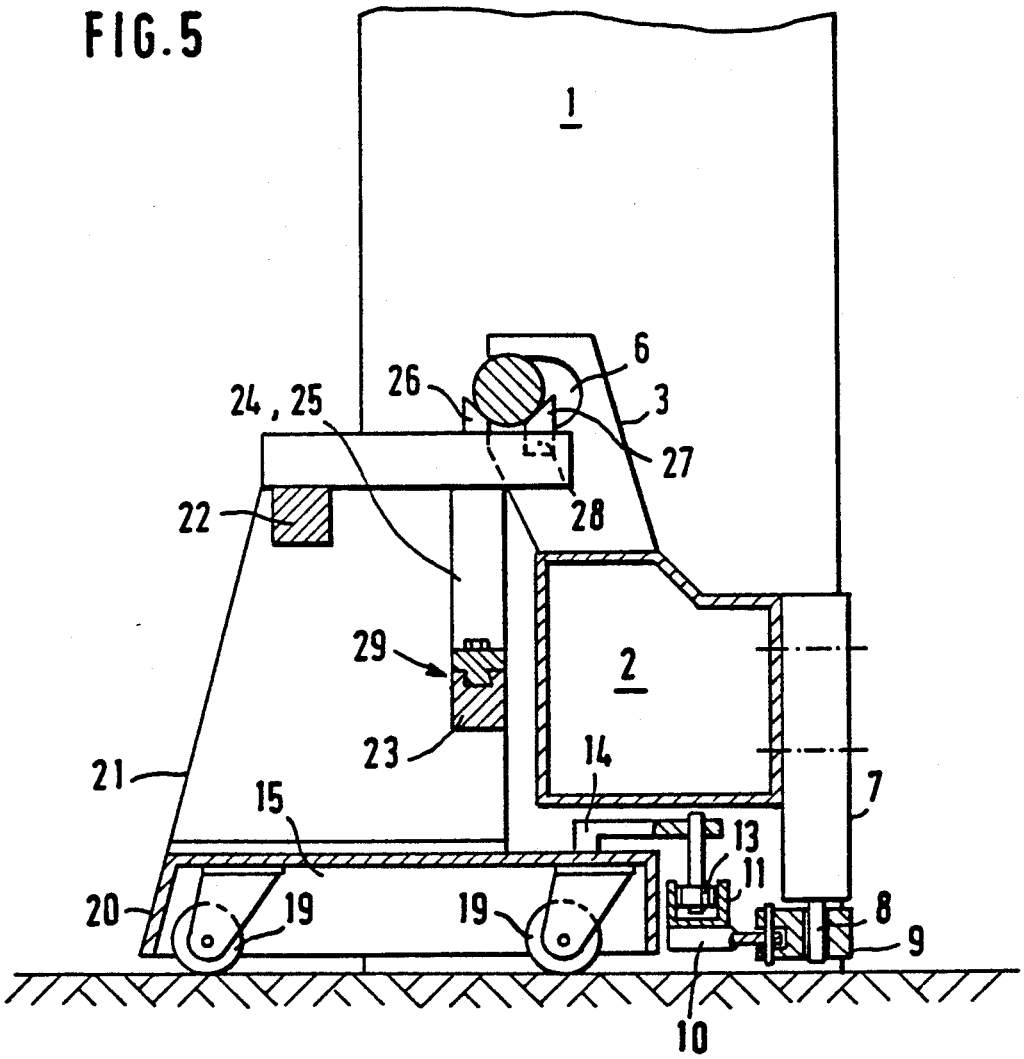
FIG. 5 is a longitudinal sectional view taken on line V—V in FIG. 4 and shows the printing press and the push-in truck.

Whereas the push-in truck 15 is only diagrammatically indicated in FIGS. 1 to 3, it is shown more clearly in FIGS. 4 and 5. From the latter Figures it is apparent that the push-in truck 15 comprises a base frame 20, which is carried by the wheels 19, to which two upwardly directed side walls 21 are secured, which are interconnected by an upper crossbeam 22 and a lower crossbeam 23. Two relatively adjustable carriers 24 and 25 are mounted on said crossbeams and are adapted to be fixed in various positions relative to each other. Each of said carriers is provided with a mounting 26, 27, which has mounting surfaces defining a prismatic recess for receiving one of the stub shafts 4 of the printing cylinder. When the stub shafts 4 have been inserted into the slots 5 and into the recesses 6, hinged parts defining the mounting surfaces 27 can be swung off about the hinge axis 28 so that the push-in truck 15 can then be moved out of the printing press. But that movement out of the printing press is not essentially required at that stage because when the stub shafts have been inserted into the slots 5 and the recesses 6 the stub shafts can slightly be lifted in known manner by locking means to a position in which they are clear of the mountings 26, 27.

It is indicated in FIGS. 4 and 5 that the carriers 24 and 25 are held by a dovetail guide 29, which is provided in the crossbeam 23, and can be locked in various positions by means of screws 30 and by bores provided in the crossbeam 23.

We claim:

1. Apparatus for moving a printing cylinder into and out of a printing press which has a frame with spaced bearing means for receiving opposite shaft ends of the printing cylinder respectively, a push-in truck for carrying the cylinder into and out of the press, an elongate track rail, slide means on the truck engageable with and slidable along the track rail and mounting means supporting the track rail between the respective bearing means for swinging movement of the track rail between an outer position and an inner position, the track rail in the outer position being inclined at an acute angle with respect to an axis connecting the respective bearing means and in said outer position one end of the track rail being accessible for moving the slide means into and out of the track rail in the direction of the inclined track rail, the track rail in the inner position being substantially parallel to said axis for transferring the cylinder between the truck and the bearing means.

2. Apparatus as claimed in claim 1 wherein the slide means comprise rollers on arms extending from the truck.

3. Apparatus as claimed in claim 1 wherein the truck is provided with rotary casters.

4. Apparatus as claimed in claim 1 wherein the truck has respective mounting assemblies for the shaft ends of the cylinder each assembly comprising opposed mounting brackets defining a prismatic recess therebetween for receiving the respective shaft end, one of the brackets being hinged for releasing the cylinder.

5. Apparatus as claimed in claim 4 wherein the respective mounting brackets are relatively adjustable.

6. Apparatus as claimed in claim 1 including guide and stop rollers on the frame for the truck.

7. Apparatus as claimed in claim 1 including guide rollers on the truck.

8. Apparatus as claimed in claim 1 wherein the mounting means includes two spaced elbow-type linkages each connected between the frame and the track rail.

9. Apparatus as claimed in claim 8 wherein one of said linkages includes a link which is longer than a corresponding link in the other of said linkages, said one of said linkages being connected to the track rail adjacent said one end of the track rail.

10. Apparatus as claimed in claim 9 including a piston-cylinder assembly connected to one of said linkages for moving the track rail between said positions.

11. Apparatus as claimed in claim 10 wherein the piston-cylinder assembly is connected to said link which is longer than a corresponding link in the other linkage.

* * * * *